US005277968A

United States Patent [19]

Canivenc

[11] Patent Number: 5,277,968

[45] Date of Patent: Jan. 11, 1994

[54] POLYORGANOSILOXANE SOFTENING/HYDROPHILIZING OF TEXTILE SUBSTRATES

[75] Inventor: Edith Canivenc, Lyons, France

[73] Assignee: Rhone-Poulenc Chimie, Courbevoie, France

[21] Appl. No.: 803,415

[22] Filed: Dec. 6, 1991

[30] Foreign Application Priority Data

Dec. 6, 1990 [FR] France ..... 90 15525

[51] Int. Cl.[5] ..... B32B 7/00

[52] U.S. Cl. ..... 428/245; 427/387; 427/389.9; 428/264; 428/265; 428/266; 428/267; 428/270; 428/290; 525/28

[58] Field of Search ..... 427/387, 389.7, 393.1, 427/397.4; 252/8.8, 8.9; 528/28; 428/245, 264, 265, 266, 267, 270, 290

[56] References Cited

U.S. PATENT DOCUMENTS 4,409,267 10/1983 Ichinohe et al. ..... 427/387

FOREIGN PATENT DOCUMENTS 44653 1/1982 European Pat. Off. .
58493 8/1982 European Pat. Off. .
2201696 9/1988 United Kingdom .

*Primary Examiner*—Michael Lusignan
*Attorney, Agent, or Firm*—Burns, Doane, Swecker & Mathis

[57] ABSTRACT

Textiles substrates, e.g., cotton fabrics, are conditioned to impart good feel and hydrophilicity thereto, by impregnating same with an effective conditioning amount of a polydiorganosiloxane containing, per mole, at least two structural units of the formula:

$$XR_aSiO_{(3-a)/2}$$

in which X is a radical:

$$-R'\left[O-CH_2\right]_t CH(OH)-CH_2-N\left[(CH_2-CH_2-O)_nR''\right]_2;$$

R′ is a linear or branched $C_2$–$C_8$ alkylene radical; R″ is a hydrogen atom or a $C_1$–$C_6$ alkyl radical; the radicals R, which may be identical or different, are each a phenyl radical, a 3,3,3-trifluoropropyl radical or an alkyl radical having from 1 to 4 carbon atoms; a is either 1 or 2; n is a number ranging from 1 to 10; and t is 0 or 1.

15 Claims, No Drawings

POLYORGANOSILOXANE SOFTENING/HYDROPHILIZING OF TEXTILE SUBSTRATES

BACKGROUND OF THE INVENTION

Field of the Invention

The present invention relates to the conditioning of textile substrates, to impart to such substrates a feel which is pleasant to the touch, i.e., softness, while at the same time imparting a good hydrophilicity thereto.

SUMMARY OF THE INVENTION

A major object of the present invention is the provision of improved technique for the conditioning of textile substrates to render same both "soft" and hydrophilic.

Another object of this invention is the provision of textile substrates which are resistant to yellowing, such textile substrates having been conditioned with an effective amount of particular polydiorganosiloxane that is easy to prepare on an industrial scale and stable in storage.

Briefly, the present invention features a process for the conditioning of textile substrates to impart a pleasant feel and good hydrophilicity thereto, comprising treating such textile substrates with an effective conditioning amount of a polydiorganosiloxane containing, per mole, at least two structural units of the formula:

$$XR_aSiO_{(3-a)/2}$$

in which X is a radical:

$$-R'\left[O-CH_2\right]_t CH(OH)-CH_2-N\left[(CH_2-CH_2-O)_nR''\right]_2;$$

R' is a linear or branched $C_2$–$C_8$ alkylene radical; R'' is a hydrogen atom or a $C_1$–$C_6$ alkyl radical; the radicals R, which may be identical or different, are each a phenyl radical, a 3,3,3-trifluoropropyl radical or an alkyl radical having from 1 to 4 carbon atoms; a is either 1 or 2; n is a number ranging from 1 to 10, inclusive; and t is 0 or 1.

DETAILED DESCRIPTION OF THE PREFERRED EMBODIMENTS OF THE INVENTION

More particularly according to the present invention, the conditioning polysiloxane advantageously has the formula:

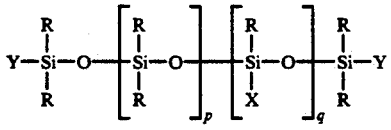

in which X and R are as defined above, Y is a radical X or a radical R, and p and q are positive integers.

In this polysiloxane, p advantageously ranges from 5 to 1,000 and q advantageously ranges from 1 to 100, with at least one Y=X if q=1.

The polydiorganosiloxane employed may optionally contain monoorganosiloxy units $RSi_{1.5}$ and/or $SiO_2$ units but, if indeed these are present, in a proportion of not more than 2% relative to the number of diorganosiloxy units $R_2SiO$, with R being as defined above.

The subject polydiorganosiloxanes are applied in the form of a preferably aqueous composition thereof, most preferably in the form of an emulsion.

The nitrogen of the group X defined above may be converted into a salt, for example by means of an organic acid such as acetic acid.

In the process according to the present invention, the composition employed advantageously comprises a polydiorganosiloxane containing, on average, per mole:

(i) from 50 to 150 silicon atoms, and (ii) from 2 to 10 groups X as defined above.

In the conditioning process of the invention, 100 g of polydiorganosiloxane as defined above typically contain 25 to 250 milliequivalents (meq) of amino nitrogen.

In the groups X comprising the above polydiorganosiloxanes, n is advantageously 1, R'' a hydrogen atom and t=1.

Moreover, if n is greater than 1, R'' is advantageously a $C_1$–$C_6$ alkyl radical.

The above polysiloxanes can easily be prepared according to the technique described in U.S. Pat. No. 3,389,160, but using diethanolamine instead of dimethylamine.

To prepare the emulsions containing the polysiloxanes described above, conventional techniques are employed using water and known surfactants, with stirring.

The process according to the present invention is applicable to any woven or knitted fabric, and even to the nonwovens.

The fibers comprising such fabrics are typically cotton, polyester, polyamide, viscose, polyacrylate, wool, linen, cellulose acetate, and elastomeric fibers, as well as mixtures thereof.

Conventional techniques in the textile arts are employed to apply the composition comprising the polysiloxane to the fabric to be treated, especially by employing the impregnation technique referred to as "padding".

When the fabric substrate is treated with an aqueous composition (for example an emulsion), this fabric is next subjected to a heat treatment to strip off the water quickly in the form of steam.

The amount of polysiloxane deposited onto the treated fabric typically ranges from 0.1% to 1% by weight relative to the weight of the dry treated fabric.

The tests used to evaluate the softness of the treated fabrics include, for example:

(1) An organoleptic test, i.e., 6 people manually handling the fabric and grading its "feel";

(2) A mechanical test, well known to this art, to determine the coefficient of static friction of a polyester yarn. To conduct this test, the polyester yarn is coated (by known technique) with a solution containing 3% by weight of the polysiloxane containing the groups X as defined above, in trichloroethane. The coated yarn is then dried continuously at 180° C. in a hot-air oven at the speed of 200 m per minutes (200 m/min). A yarn is thus obtained on which the deposit of polydiorganosiloxane corresponds to 0.5% by weight relative to the weight of the dry yarn. The yarn is then stored for 48 hours at 22° C. and 65% relative humidity. The coefficient of friction of the yarn obtained is then determined in a Rothschild F. Meter apparatus at a speed of 1 cm/min (centimeters per minute).

The test used to evaluate the hydrophilicity of the fabrics treated according to the process of the present invention is a test entailing depositing a piece of treated fabric (25.4×25.4 mm) parallel to the surface of distilled water placed in a beaker and measuring the time between the deposition of this fabric on the water and the beginning of its descent into the water. This test is referred to as a "sinking test".

In order to further illustrate the present invention and the advantages thereof, the following specific examples are given, relating to the preparation of polysiloxanes containing functional groups X and to the use of such polysiloxanes, it being understood that same are intended only as illustrative and in nowise limitative.

EXAMPLE 1

1(a) The following materials were introduced into a reactor equipped with stirring means, a thermometer, a dropping funnel, a condenser and a system for introducing dry nitrogen:

(i) 504.30 g (4.42 mol) of allyl glycidyl ether, (ii) 289 microliters of a hexane solution (containing 9.05% by weight of platinum metal) of a platinum complex prepared from chloroplatinic acid and 1,3-divinyl-1,1,3,3-tetramethyldisiloxane according to U.S. Pat. No. 3,814,730.

The reaction mixture was heated to and maintained at 100° C., and 1,700 g of a random SiH copolymer having the average formula:

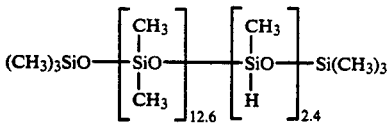

analyzing at 200.17 meq/100 g as SiH functional groups (meq=milliequivalent), were added thereto over 2 hours, 30 min.

After 5 hours, 30 min, of reaction it was noted, by determining residual SiH groups using butanolic potassium hydroxide, that the degree of conversion of the SiH functional groups was quantitative, namely, the SiH groups of the starting polymer had been converted into:

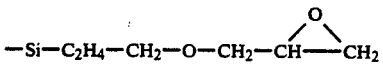

After removal of the excess reactant (allyl glycidyl ether) by distillation at 120° C. (at an absolute pressure of 3.3 kPa), 2,070 g of organosiloxane oil were obtained, analyzing at 156.25 meq/100 g as glycidyl functional group.

1(b) 317 g (3.01 mol) of diethanolamine were introduced into another reactor and the reaction medium was heated to 120° C. 1,800 g of the organosiloxane derivative containing a glycidyl functional group, prepared in 1(a), were then added thereto over 2 hours, 30 min.

After 6 hours, 30 min, of reaction 2,113.4 g of a pale-yellow viscous oil were obtained, having a viscosity of 3,000 mPas at 23° C. A quantitative degree of conversion of diethanolamine was determined by titrating the diethanolamine in the final reaction mixture (using polarography).

A proton and silicon nuclear magnetic resonance (NMR) analysis was carried out. The interpretation of the spectra confirmed the structure of the expected product, i.e., a polymer of the average formula:

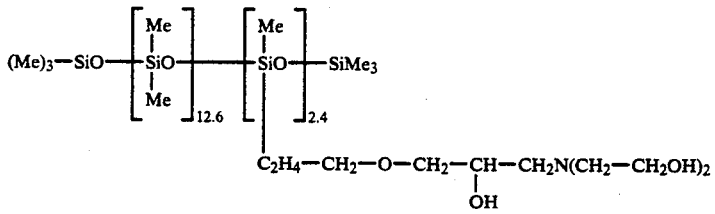

wherein Me=—$CH_3$

EXAMPLE 2

2(a) The same operations were carried out as in Example 1(a), using:

(i) 1,500 g of a random SiH copolymer having the formula:

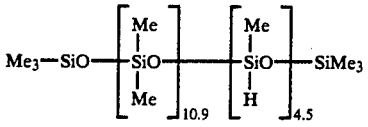

analyzing at 365.5 meq/100 g as SiH functional group, (ii) 806.15 g (7.07 mol) of allyl glycidyl ether, (iii) 331.5 μl (microliters) of platinum catalyst solution as described in 1(a)

After 5 hours of reaction, the degree of conversion of the SiH groups was quantitative. After removal of the excess allyl glycidyl ether 2,112 g of oil were obtained, analyzing at 251.44 meq/100 g as glycidyl functional group.

2(b) The same operations as in Example 1(b) were carried out, using:

(i) 1,700 g of the organosiloxane derivative containing a glycidyl functional group, prepared in 2(a), (ii) 482 g (4.23 mol) of diethanolamine.

After 6 hours, 30 min, of reaction 2,179.5 g of a yellow viscous oil were obtained; its viscosity at 25° C. was 23,000 mPa.s. The various analyses carried out confirmed the structure of the expected product, namely:

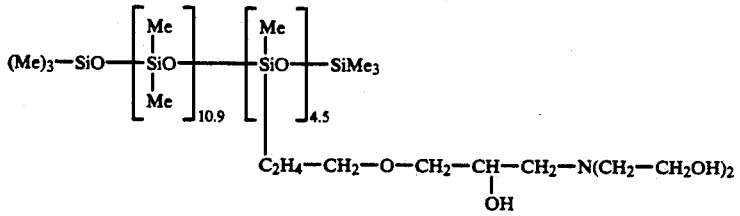

EXAMPLE 3

3(a) The same operations were carried out as in Example 1(a), using:

(i) 121.35 g (1.06 mol) of allyl glycidyl ether, (ii) 1,340 g of a random SiH copolymer having the formula:

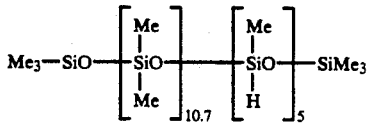

analyzing at 61.11 meq/100 g as SiH functional group, (iii) 228 μl of the platinum catalyst solution described in 1(a).

The reaction mixture was heated to and maintained at 100° C. After 2 hours of heating, the degree of conversion of the SiH functional groups was quantitative. After the removal of the excess allyl glycidyl ether, 1,423 g of organosiloxane oil were obtained, analyzing at 54.7 meq/100 g as glycidyl functional group.

3(b) The same operations as in Example 1(b) were carried out, using:

(i) 150 g of the organosiloxane derivative containing a glycidyl functional group and prepared in 3(a), (ii) 8.92 g (0.078 mol) of diethanolamine.

After 8 hours of reaction 158.16 g of an ochrecolored viscous oil were obtained, having a viscosity of 9,500 mPa.s.

The various analyses confirmed the structure of the product obtained, namely, a product in which the SiH functional groups (of the product employed in 3(a)) had been replaced by the functional groups: —Si—$C_2H_4$—$CH_2$—O—$CH_2$—CH(OH)—$CH_2$—N($C_2H_4OH$)$_2$

EXAMPLE 4

4(a) The operation was carried out under the same conditions as in Example 1(a), using:

(i) 350 g of a random SiH copolymer having the formula:

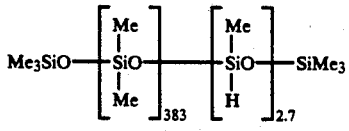

analyzing at 9.48 meq/100 as SiH functional group, (ii) 11.34 g (1.00 mol) of allyl glycidyl ether, (iii) 46.55 μl of platinum catalyst solution.

After 2 hours of reaction at 100° C. the degree of conversion of the SiH functional groups was quantitative. After removal of the excess reactant, 350.2 g of organosiloxane oil were obtained, analyzing at 9.5 meq/100 g as glycidyl functional group.

4(b) The same operations were carried out as in Example 1(b), using:

(i) 2.2 g (0.019 mol) of diethanolamine, (ii) 200 g of the organosiloxane derivative containing a glycidyl functional group, prepared in 4 (a).

After 5 hours of heating at 125° C. an ochrecolored oil was obtained, having a viscosity of 16,400 mPa.s at 25° C., of the average formula:

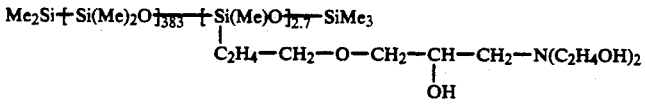

EXAMPLE 5

5(a) According to the operating conditions which were identical with those of Example 4(a), an organosiloxane oil was synthesized, having the average structure:

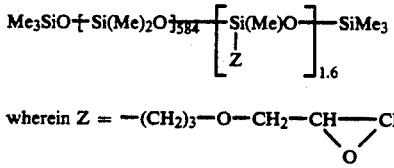

wherein Z = analyzing at 3.7 meq/100 g as glycidyl functional group.

5(b) Diethanolamine was condensed with the oil containing a glycidyl functional group, prepared in 5(a), under conditions which were similar to those of Example 4(b). This produced the product corresponding to that according to 5(a), but in which Z had been replaced with: —$C_2H_4$—$CH_2$—O—$CH_2$—CH(OH)—$CH_2$—N($C_2H_4OH$)$_2$

EXAMPLE 6

Using operating conditions similar to those of Example 4(b), the condensation of diethanolamine was carried out, with an organosiloxane oil having the average formula:

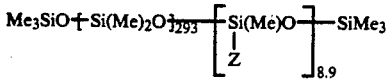

wherein Z = $-(CH_2)_3-O-CH_2-CH(\diagup O \diagdown)-CH_2$ analyzing at 36.6 meq/100 g as glycidyl functional group.

A product was thus obtained, whose average formula corresponded to the above product, but in which Z had been replaced by: $(CH_2)_3-O-CH_2-CH(OH)-CH_2-N(C_2H_4OH)_2$.

Table 1 below reports the characteristics of the organosiloxane oils containing diethanolamine functional groups and synthesized in Examples 1 to 6:

TABLE 1

| Example | Average no. of Si/mole of polymer | Average no. of X*/mole of polymer | Quantity of amine in meq/100 g of polymer |
|---|---|---|---|
| 1 | 17 | 2.4 | 142 |
| 2 | 17 | 4.5 | 210 |
| 3 | 114 | 5 | 46 |
| 4 | 388 | 2.7 | 9.4 |
| 5 | 588 | 1.6 | 3.7 |
| 6 | 304 | 8.9 | 40 |

*X = $-(CH_2)_3-O-CH_2-CH(OH)-CH_2-N(C_2H_4OH)_2$

USE OF THE POLYMERS PREPARED ACCORDING TO EXAMPLES 1 TO 6:

Emulsions were prepared from the polymers prepared in Examples 1 to 6.

(a) Emulsions were prepared from the products according to Examples 1 and 2 as follows:

(i) 20% of Tergitol TMN 10 (by weight), (ii) 0.55% of glacial acetic acid, and (iii) 55% of water, were mixed in a round-bottom flask fitted with a three-bladed stirrer in which the ends of two blades were 5 cm apart, and rotating at 550 revolutions per minute.

20% (by weight) of the product according to Example 1 or 2 was then added slowly to this stirred solution.

(b) Emulsions were prepared from the products according to Examples 4 and 5 as follows:

The following materials were mixed in a Silverson trademark laboratory mixer:

(i) 104 of the polymer according to Example 4 or 5, (ii) 0.55% of Tergitol TMN 6, (iii) 0.55% of Renex 30.

The following was then added slowly and continuously to this well-stirred mixture:

88.9% of water, using the phase-inversion technique.

(c) The same operation as in (b) was carried out using the product obtained according to Example 6, but using 73.9% of water, and, after the water had been introduced, 15% of 2-propanol was added.

(d) Two types of emulsion were prepared from the product obtained according to Example 3:

d(1) A first emulsion by operating according to (a), but with:

(i) 10% of Tergitol TMN6, and (ii) 70% of water.

d(2) A second emulsion by operating according to (b), but without Renex 30 and with:

(i) 0.8% of Tergitol TMN 6, and (ii) 89.2% of water.

After preparation, the emulsion was adjusted to pH 6 with acetic acid.

The products Tergitol TMN 10, Tergitol TMN 6 and Renex 30 are surfactants which are widely available commercially and well known to this art.

Tergitol TMN 6 comprises a trimethylnonanol containing 6 oxyethylene units as the active agent.

Tergitol TMN 10 comprises a trimethylnonanol containing 10 oxyethylene units as the active agent.

Both these products are marketed by Union Carbide.

Renex 30, marketed by ICI, comprises a tridecylol containing 10 oxyethylene units as the active agent.

The tests:

(a) organoleptic (on towelling cotton), (b) to determine the static coefficient of friction, (c) for hydrophilicity, by soaking the fabric (towelling cotton) in a beaker, as described above, were performed using the emulsions prepared above.

The results obtained are reported in Table 2 below:

TABLE 2

| Organosiloxane derivatives according to Example | 1 | 2 | 3 | 4 | 5 | 6 |
|---|---|---|---|---|---|---|
| Organoleptic feel | U | U | P | P | P | P |
| Coefficient of friction | 0.70 | 0.21 | 0.17 | 0.10 | 0.45 | 0.14 |
| Hydrophilicity time in seconds, Sinking test | 4 | 4 | 20 | >300 | >300 | >300 |

P = pleasant, soft feel,
U = unpleasant feel, without softness.

It will be appreciated that the product prepared according to Example 3 was that which best corresponded to the required application, namely, having a soft feel and good hydrophilicity, when the fabric was cotton.

With regard to this product according to Example 3, it has been found that the emulsion prepared according to d(1) imparted a better resistance to yellowing to a white cotton fabric than the emulsion prepared according to d(2).

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the conditioning of a textile substrate to impart good feel and hydrophilicity thereto, comprising impregnating such textile substrate with an effective conditioning amount of a polydiorganosiloxane containing, per mole, at least two structural units of the formula:

$$XR_aSiO_{(3-a)/2}$$

in which X is a radical:

$$-R'\left[O-CH_2\right]_t CH(OH)-CH_2-N\left[(CH_2-CH_2-O)_nR''\right]_2;$$

R' is a linear or branched $C_2$–$C_8$ alkylene radical; R'' is a hydrogen atom or a $C_1$–$C_6$ alkyl radical; the radicals R, which may be identical or different, are each a phenyl radical, a 3,3,3-trifluoropropyl radical or an alkyl radical having from 1 to 4 carbon atoms; a is either 1 or 2; n is a number ranging from 1 to 10; and t is 0 or 1.

2. The process as defined by claim 1, said polydiorganosiloxane having the formula:

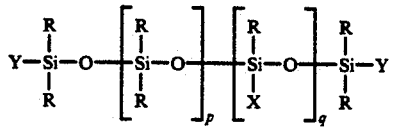

in which Y is a radical X or a radical R, and p and q are positive integers.

3. The process as defined by claim 2, wherein said polydiorganosiloxane, p ranges from 5 to 1,000 and q ranges from 1 to 100, with the proviso that at least one Y is X when q is 1.

4. The process as defined by claim 1, wherein said polydiorganosiloxane, n is 1, R'' is a hydrogen atom and t is 1.

5. The process as defined by claim 1, the nitrogen of the radical X of said polydiorganosiloxane comprising a salt thereof.

6. The process as defined by claim 1, said polydiorganosiloxane containing, on average per mole, from 50 to 150 silicon atoms and from 2 to 10 radicals X.

7. The process as defined by claim 1, said polydiorganosiloxane comprising from 25 to 250 meq of amino nitrogen per 100 g thereof.

8. The process as defined by claim 1, said textile substrate comprising a woven, nonwoven or knit fabric.

9. The process as defined by claim 8, said textile substrate comprising cotton, polyester, polyamide, viscose, polyacrylate, wool, linen, cellulose acetate or elastomeric fibers.

10. The process as defined by claim 9, said textile substrate comprising cotton fibers.

11. The process as defined by claim 1, said polydiorganosiloxane comprising an aqueous formulation thereof.

12. The process as defined by claim 11, said aqueous formulation comprising an emulsion.

13. The process as defined by claim 1, said textile substrate comprising from 0.1% to 1% by weight of said polydiorganosiloxane.

14. A textile substrate impregnated with a good feel and hydrophilicity-imparting amount of a polydiorganosiloxane containing, per mole, at least two structural units of the formula:

$$XR_aSiO_{(3-a)/2}$$

in which X is a radical:

$$-R'\left[O-CH_2\right]_t CH(OH)-CH_2-N\left[(CH_2-CH_2-O)_nR''\right]_2;$$

R' is a linear or branched $C_2$–$C_8$ alkylene radical; R'' is a hydrogen atom or a $C_1$–$C_6$ alkyl radical; the radicals R, which may be identical or different, are each a phenyl radical, a 3,3,3-trifluoropropyl radical or an alkyl radical having from 1 to 4 carbon atoms; a is either 1 or 2; n is a number ranging from 1 to 10; and t is 0 or 1.

15. A process for the conditioning of a textile substrate to impart good feel and hydrophilicity thereto, comprising impregnating such textile substrate with an effective conditioning amount of a polydiorganosiloxane containing, per mole, at least two structural units of the formula:

$$XR_aSiO_{(3-a)/2}$$

in which X is a radical:

$$-R'\left[O-CH_2\right]_t CH(OH)-CH_2-N\left[(CH_2-CH_2-O)_nR''\right]_2;$$

R' is a linear or branched $C_2$–$C_8$ alkylene radical; R'' is a hydrogen atom or a $C_1$–$C_6$ alkyl radical; the radicals R, which may be identical or different, are each a phenyl radical, a 3,3,3-trifluoropropyl radical or an alkyl radical having from 1 to 4 carbon atoms; a is either 1 or 2; n is a number ranging from 1 to 10; and t is 0 or 1; said polydiorganosiloxane containing, on average per mole, from 50 to 150 silicon atoms and from 2 to 10 X radicals.

* * * * *